US005177840A

United States Patent [19]

Laws

[11] Patent Number: 5,177,840

[45] Date of Patent: Jan. 12, 1993

[54] PRODUCTION OF HYBRID YARN

[75] Inventor: Regina Laws, Weinheim, Fed. Rep. of Germany

[73] Assignee: BASF Aktiengesellschaft, Ludwigshafen, Fed. Rep. of Germany

[21] Appl. No.: 774,910

[22] Filed: Oct. 11, 1991

[30] Foreign Application Priority Data

Nov. 20, 1990 [DE] Fed. Rep. of Germany ..... 4036926

[51] Int. Cl.[5] ..... D02J 11/00; D02G 1/20; D01D 11/02

[52] U.S. Cl. ..... 28/220; 28/282; 28/181; 28/167

[58] Field of Search ..... 28/220, 282, 283, 178, 28/181, 135, 167, 169

[56] References Cited

U.S. PATENT DOCUMENTS 3,680,303 8/1972 Kim ..... 28/220 X
3,738,093 6/1973 Ingham ..... 28/282 X
3,739,564 6/1973 King ..... 28/282 X
3,739,566 6/1973 Smith ..... 28/282 X
4,343,146 8/1982 Nelson ..... 28/220 X
4,799,985 1/1989 McMahon et al. ..... 28/283 X
4,871,491 10/1989 McMahon et al. ..... 57/350 X
4,874,563 10/1989 McMahon et al. ..... 57/350 X
4,972,563 11/1990 Wheeler ..... 28/220
5,063,099 11/1991 Tedesco et al. ..... 28/282 X

*Primary Examiner*—Werner H. Schroeder
*Assistant Examiner*—Bibhu Mohonty
*Attorney, Agent, or Firm*—William G. Conger

[57] ABSTRACT

Hybrid yarn is produced from thermoplastic and reinforcing fibers by spreading the fibers separately to form a band and combining and homogeneously intermixing the two bands on rolls or rods. The spreading is carried out in such a way that the reinforcing fiber band will be from 20 to 100% wider than the thermoplastic fiber band. The hybrid yarn can be sized and processed into fabrics which can be molded to produce fiber composites.

8 Claims, 1 Drawing Sheet

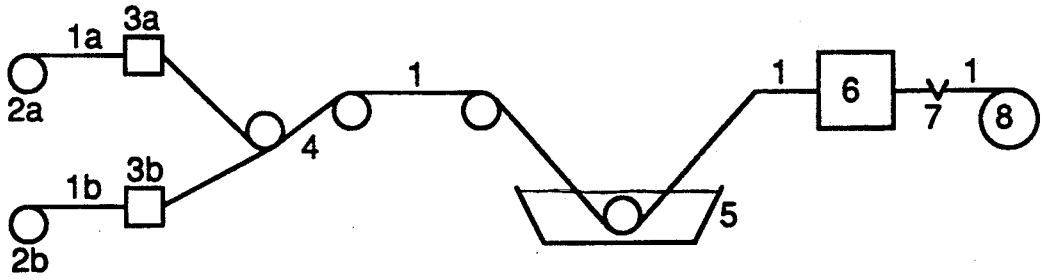
1a
3a
2a
1b
3b
2b
4
1
1
6
1
7
8
5

PRODUCTION OF HYBRID YARN

The present invention relates to a process for producing hybrid yarn of improved processibility.

Hybrid yarn is a blend yarn in which continuous thermoplastic fibers and reinforcing fibers are homogeneously intermixed. In the form of textile sheet materials, for example laid or woven fabrics, such a yarn is readily formable and drapable into three-dimensional structures. These structures are moldable at temperatures above the softening point of the thermoplastic to form high-quality fiber composites.

EP-B-156 599 describes a process for producing a hybrid yarn wherein a thermoplastic fiber tow and a carbon fiber tow are each separately spread and then recombined and intermixed.

In said process, the two fiber tows are supposed to be spread to virtually the same width. The hybrid yarn thus produced can be provided with a size and be processed inter alia into a woven fabric. It has now been found that yarns which have been produced as described in EP-B-156 599 do not fully absorb the size, so that, in the course of weaving, the fibers can split open and fiber breakages can occur, the consequence of which is that the laminates produced from the woven fabrics do not have consistently good mechanical properties.

It is an object of the present invention to improve the hybrid yarn produced in EP-B-156 599 in such a way that it can be properly sized and satisfactorily woven, so that laminates produced therefrom always have consistently good mechanical properties, in particular good tensile strength.

We have found that this object is achieved according to the present invention when the spreading is carried out in such a way that the reinforcing fiber band will be from 20 to 100% wider than the thermoplastic fiber band.

For the purposes of the present invention, fibers are bundles of continuous parallel filaments.

The thermoplastic fibers may in principle be made of any thermoplastic material which can be spun into fibers. Preference is given to partly crystalline thermoplastics having a melting point above 50° C., preferably above 100° C. Of particular suitability are polyether ketones, polyimides, polyphenylene sulfide, polyamides, polybutylene terephthalate, polyethylene terephthalate and liquid crystal polyesters. The fibers generally have bundle or tow linear densities of from 500 to 20,000, preferably of from 500 to 5,000, dtex and filament counts of from 100 to 10,000, each filament having a diameter of from 10 to 60 μm, preferably from 20 to 40 μm.

Suitable reinforcing materials are fibers of carbon, glass, metal, boron, boron nitride, silicon carbide and aromatic polyamide. Preference is given to glass and in particular carbon fibers. Generally they have bundle or tow linear densities within the range from 1,000 to 10,000 dtex and filament counts of from 1,000 to 45,000, preferably 3,000 to 12,000, each filament having a diameter of from 3 to 150 μm.

The proportion of thermoplastic fibers in the hybrid yarn can be set via the bundle or tow linear densities of the thermoplastic and reinforcing fibers. Moreover, the thermoplastic fibers may also be taken off a plurality of spools and grouped together. In the ready-produced hybrid yarn, the thermoplastic content should preferably be within the range from 30 to 75% by volume, in particular within the range from 35 to 65% by volume.

The drawing is a flow diagram of the process of the present invention.

Carbon fibers (1*a*) and thermoplastic fibers (1*b*) are taken off spools (2*a*) and (2*b*) respectively. The fibers then pass through spreading means (3*a*) and (3*b*) respectively. The spreading can in principle be effected using spreading combs, but preference is given to apparatus in which the fibers are subjected to a liquid or gas jet. A particularly preferred air jet apparatus is described in detail in EP-B-156 599. The gas pressure used in spreading should be sufficiently high to overcome the capillary forces which hold the individual filaments together, but it must not be so high as to cause fiber breakage. In the case of carbon fibers air pressures of from 0.05 to 1 bar are sufficient, while in the case of thermoplastic fibers pressures within the range from 0.05 to 2 bar can be employed.

The width of the bands which are produced in the course of spreading can be influenced not only via the pressure of the impinging liquid or air but also via the fiber tension, which in general is within the range from 20 to 200 g, preferably within the range from 30 to 120 g. The width of the bands may vary within the range from 2 to 10 cm, preferably within the range from 3 to 8 cm. According to the present invention, the reinforcing fiber band must be from 20 to 100%, preferably from 40 to 80%, wider than the thermoplastic fiber band.

After spreading, the bands are brought together via rolls or rods (4), the arrangement of these rolls or rods preferably being such that the intermixed band is deflected twice. This ensures homogeneous mixing between the two kinds of fiber, so that ideally in the hybrid yarn thermoplastic filaments and reinforcing filaments will be present in a random arrangement. Additionally to the rolls or rods the intermixed band may additionally be subjected to a further gas jet means for entanglement. In some cases this will make it possible to improve the intermixing still further.

The intermixed band may then be passed through a liquid bath (5) which contains a size solution. It is possible to use customary textile sizes, for example those based on polyvinyl alcohol, polyvinylpyrrolidone or polyacrylates. The size makes it possible to process the mixed band into textile sheet materials, for example by weaving. After the size bath the intermixed band passes through a drying means (6) in which the solvent of the size solution is removed. Then the band is compacted in an apparatus (7) to a compact cross-section. The apparatus (7) can be for example a roll with a V- or U-shaped internal cross-section. Finally, the hybrid yarn is wound onto a spool (8).

The hybrid yarn produced according to the present invention can be conventionally processed without problems, ie. without fiber breakages, into woven or knitted fabrics. These fabrics can then be molded at temperatures above the melting point of the thermoplastic to produce fiber composites.

We claim:

1. A process for the preparation of hybrid yarn containing continuous reinforcing fibers and continuous thermoplastic fibers, comprising the steps of:

a) spreading a first thermoplastic fiber bundle to form a band of thermoplastic filaments;

b) spreading a second reinforcing fiber bundle to form a band of reinforcing filaments, the width of said second band being from 20 to about 100 percent greater than the width of the first band of thermoplastic filaments;

c) homogeneously intermixing said bands; and d) sizing said bands and recompacting the bundles into a bundle of compact cross-section.

2. The process of claim 1 wherein said first band of reinforcing filaments has a width from 40 to about 80 percent greater than the width of the second band of thermoplastic filaments (a).

3. The process of claim 1 wherein said homogenous intermixing is accomplished through the use of rollers or rods.

4. The process of claim 2 wherein said homogenous intermixing is accomplished through the use of rollers or rods.

5. The process of claim 1 wherein said homogenous intermixing is accomplished through the use of gas jet intermixing means.

6. The process of claim 2 wherein said homogenous intermixing is accomplished through the use of gas jet intermixing means.

7. The process of claim 3 wherein said homogenous intermixing through use of rollers or rods is assisted by the use of gas jet intermixing means.

8. The process of claim 5 wherein said homogenous intermixing through use of rollers or rods is assisted by the use of gas jet intermixing means.

* * * * *